United States Patent [19]

Dickinson

[11] 4,126,333

[45] Nov. 21, 1978

[54] METHOD OF PREPARING A PUBLICATION WITH A SEPARABLE REDEMPTION COUPON OR THE LIKE

[75] Inventor: Robert H. Dickinson, Plandome, N.Y.

[73] Assignee: Lehigh Press Inc., Pennsauken, N.J.

[21] Appl. No.: 802,811

[22] Filed: Jun. 2, 1977

[51] Int. Cl.[2] ..... B42D 1/00

[52] U.S. Cl. ..... 281/3 R; 281/38

[58] Field of Search ..... 281/3, 38, 1; 282/1, 282/2; 270/21

[56] References Cited

U.S. PATENT DOCUMENTS

| | | | |
|---|---|---|---|
| 1,114,920 | 10/1914 | Seeligson | 281/3 R |
| 1,385,569 | 7/1921 | Mayer et al. | 270/21 |
| 2,631,845 | 3/1953 | Zuckerman | 270/21 X |
| 3,560,025 | 2/1971 | Ostrander | 281/3 R |
| 3,588,085 | 6/1971 | Bailey | 281/3 R UX |
| 3,593,987 | 7/1971 | Garber | 281/38 X |
| 3,799,536 | 3/1974 | Gregoire | 270/21 X |

*Primary Examiner*—Frank T. Yost
*Attorney, Agent, or Firm*—Bauer & Amer

[57] ABSTRACT

In the embodiment of a redemption coupon in a magazine or other bound publications, there are inconveniences if the coupon is physically removed from a page of the magazine, since the remaining partial page is difficult to turn, text is also inadvertently removed, etc. Thus, it is desirable that the coupon be removable with effect on its adjacent magazine pages thus dictating that there be no physical connection between it and the magazine pages. On the other hand, handling of a small coupon-size panel during preparation of the magazine has obvious shortcomings. As a solution to the foregoing, the within method contemplates the use of a physically attached coupon and page, and subsequent folding thereof so that the "physical attachment" therebetween is advantageously presented to the cutting blade used in the conventional edge-trimming step in the preparation of the magazine, and is thus removed during this step, thereby providing the desired separable redemption coupon for the magazine.

10 Claims, 13 Drawing Figures

METHOD OF PREPARING A PUBLICATION WITH A SEPARABLE REDEMPTION COUPON OR THE LIKE

The present invention relates generally to improvements in the preparation of a magazine or publication, and more particularly to a practical, inexpensive assemblage method which effectively provides the magazine with one or more separable redemption coupons, self-addressed postcards, or other such promotional panel of the type that contemplates physical removal from the magazine preparatory to its use.

Despite obvious disadvantages, the most popular technique of embodying a redemption coupon in a magazine is to print it on one of the pages. Undoubtedly, the inconveniences associated with having a partial page after removal of the coupon outweigh the more serious inconveniences, and expenses, of attempting to handle a small coupon-size panel during preparation of the magazine for binding and other steps in its production.

Broadly, it is an object of the present invention to provide any selected number of separable redemption coupons or the like in a magazine, and to do so using a magazine-production method overcoming the foregoing and other shortcomings of the prior art. Specifically, it is an object to provide a magazine benefiting from the embodiment therein, of a separable redemption coupon, and yet produced without having to use substandard size, difficult-to-handle, inserts.

A method of embodying a publication with a separable redemption coupon demonstrating objects and advantages of the present invention contemplates, as a first step, arranging on the same paper substrate said redemption coupon adjacent an end thereof with a separation strip delineating the coupon from an advertising page imprinted on the remainder of the paper substrate. Next, the redemption coupon is bodily folded upon the advertising page along a fold line located in the separation strip and is inserted with said fold line thereof in a horizontal orientation in binding relation with other pages of the publication. Thus, when trimming is subsequently done inwardly of the unbound three edges of the publication to contribute to a neat appearance therein, this trimming is also effective to separate the redemption coupon from the advertising page enabling it to be removed without adverse effect on the advertising page.

The above brief description, as well as further objects, features and advantages of the present invention, will be more fully appreciated by reference to the following detailed description of presently preferred, but nonetheless illustrative embodiments demonstrating the practice of the within inventive method, when taken in conjunction with the accompanying drawings, wherein:

FIG. 1 is a perspective view of a typical prior art publication embodying a redemption coupon or the like;

FIG. 2B is a plan view illustrating the printing preparation of a paper substrate providing a redemption coupon and an associated advertising page;

FIG. 2C illustrates the folding of said paper substrate of FIG. 2B;

Figure 2A:
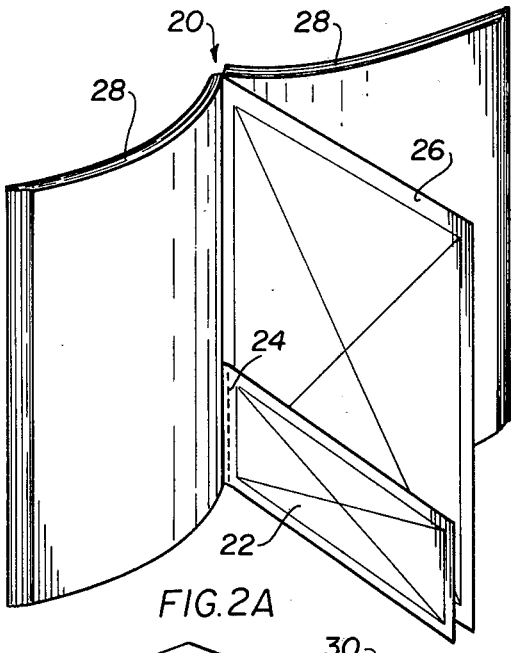
FIG. 2A is similarly a perspective view of a publication, but illustrating an improved manner, according to the present invention, in which a redemption coupon is embodied therein.
Figure 2C:
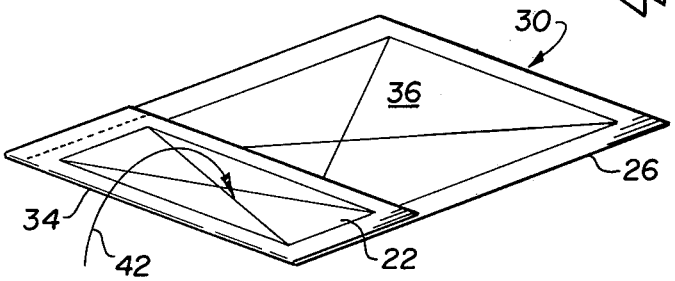
FIGS. 2B–2E illustrate, in sequence, the method of preparing a publication so as to achieve the result illustrated in FIG. 2A. More particularly.
Figure 2B:
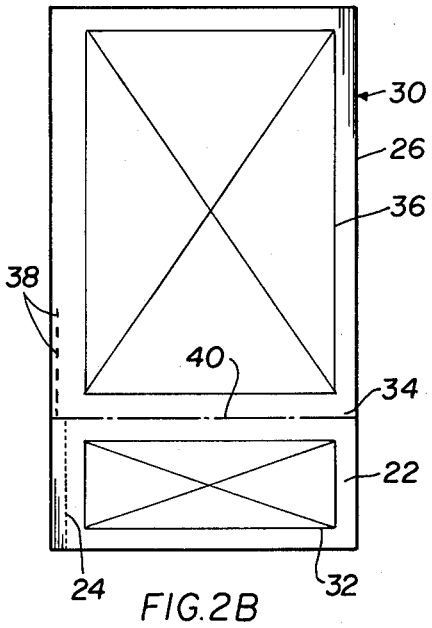
Figure 2D:
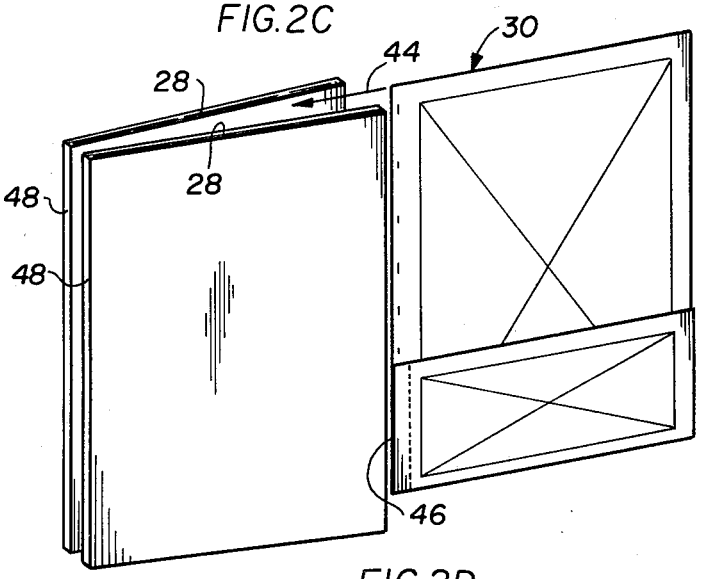
Figure 2E:
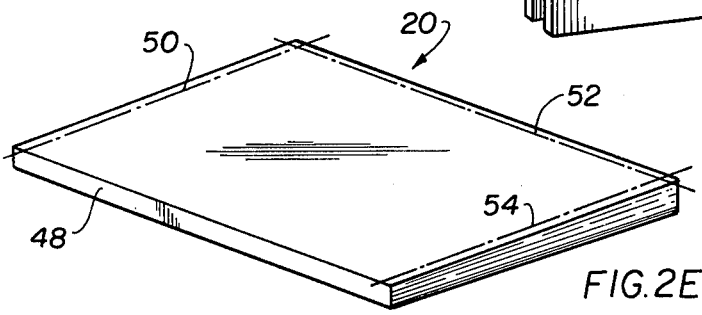

FIG. 2D is a perspective view illustrating the assemblage or insertion of the folded paper substrate of FIG. 2C preparatory to the binding of same with other pages in the formation of a unitary publication; and FIG. 2E is a perspective view illustrating the trimming of the unbound edges of the publication for finishing same and also, as will be subsequently explained, completing the production of a separable redemption coupon as exemplified in FIG. 2A.

Figure 3A:
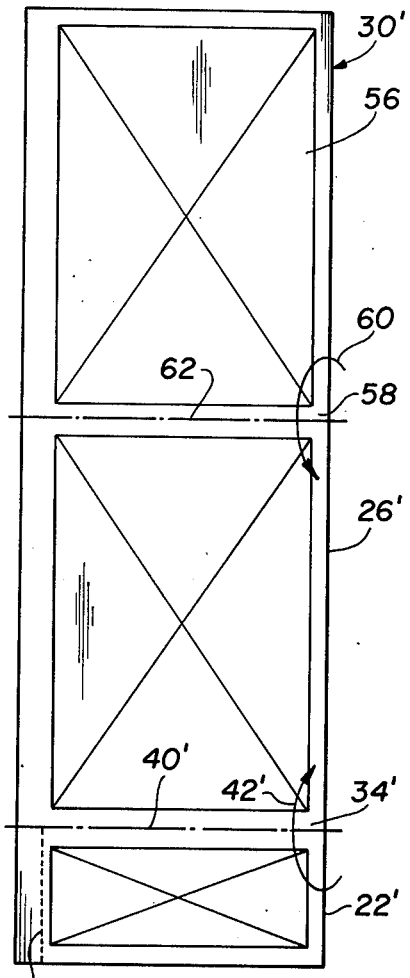
Figure 3B:
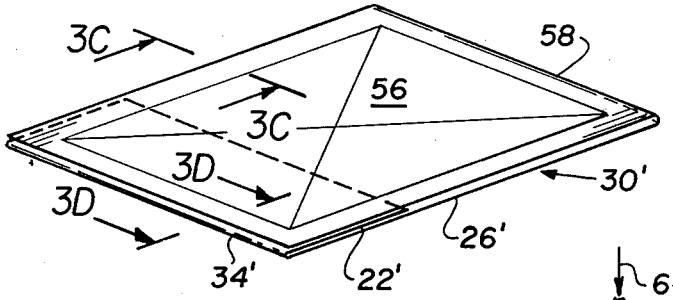
Figure 3C:
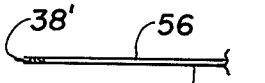
Figure 3D:
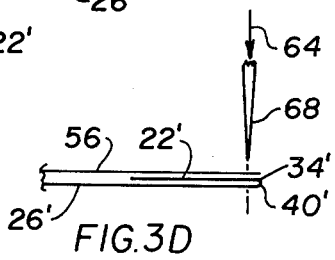
Figure 3E:
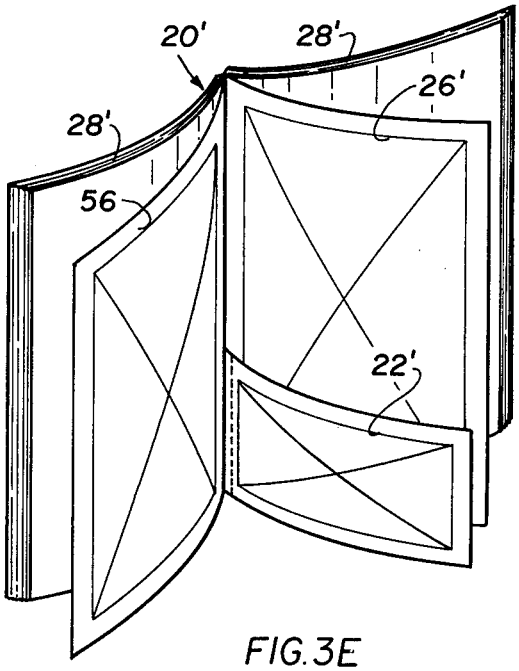

FIGS. 3A–3B illustrate another embodiment of a separable redemption coupon or the like using a slightly varied procedure from that illustrated in FIGS. 2A–2E. Specifically, FIG. 3A is a plan view showing the layout on a paper substrate of two advertising pages and a redemption coupon;

FIG. 3B illustrates the manner of folding the paper substrate of FIG. 3A;

FIGS. 3C and 3D are elevational views, in section, respectively taken on line 3C—3C and 3D—3D of FIG. 3B, illustrating further structural details; and FIG. 3E is a perspective view of a publication illustrating product aspects of a separable coupon or the like that results from the use of the assemblage method illustrated by FIGS. 3A–3D.

Figure 4A:
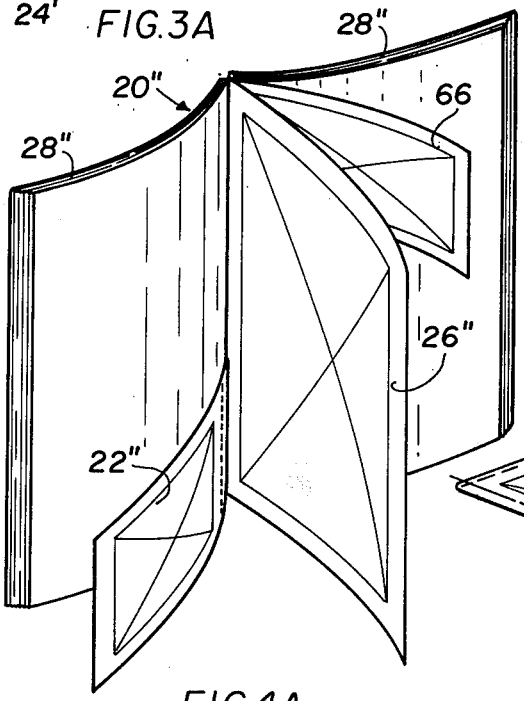
Figure 4B:
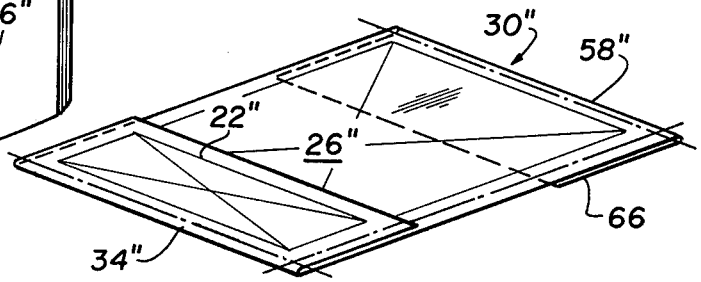

Remaining FIGS. 4A and 4B illustrate still another way in which separable coupons can be embodied in a publication using a slightly varied method according to the present invention of preparing said publication. More particularly, FIG. 4A is a perspective view of the publication illustrating the inclusion of two separable redemption coupons and an intermediate advertising page associated therewith; and FIG. 4B is a perspective view illustrating how the trimming of a paper substrate prepared and folded in accordance with the present invention provides the result illustrated in FIG. 4A.

Figure 1:
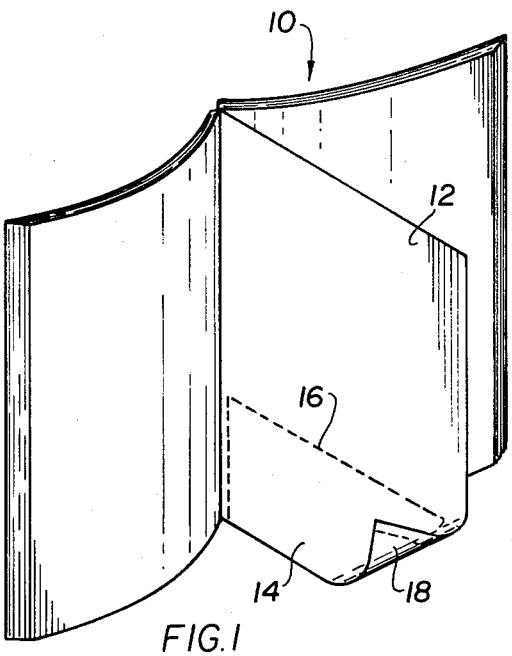
FIG.1 PRIOR ART

It is suggested that reference first be made to FIG. 1 which illustrates a typical prior art publication or magazine, generally designated 10, which typically may have on one or more page 12 a redemption coupon, mailing piece or the like 14 delineated by a line of perforations 16 from the remaining body of page 12. Naturally, in lieu of perforations 16, there may be merely printed guide lines to assist in cutting the coupon 14 out of the page 12. In either instance, what is illustrated in FIG. 1 is a typical situation which contemplates the removal of portion 14 of page 12 because it is a redemption coupon, a mailing postal card, etc. Not only is it inconvenient in using the publication 10 to have to contend with the partial page 12 having portion 14 removed therefrom, but the removal of the coupon 14 of necessity correspondingly removes text 18 that invariably is part of a story or other article appearing on the reverse surface of page 12, thus resulting in further inconvenience for the reader.

As a significant improvement, and as illustrated in FIG. 2A, the inventive method hereof can provide a publication 20 having a coupon 22 or the like readily detachable along perforations 24 that is noteworthy because it is completely unattached, i.e. separate and apart from, an associated advertising page 26 occupying an adjacent position to the coupon 22.

While publication 20 with a separable redemption coupon 22, as just defined, has heretofore been used, the cost and difficulty of providing same has been almost prohibitive. The separate, detached coupon 22 has heretofore been required to be inserted separately into binding position along with its adjacent and other pages 26, 28 respectively, in the preparation of the publication 20. The handling of the smaller coupon-sized panel 22 is difficult at best, necessitates its own feeding hopper, and thus these and other reasons probably accounts for the fact that heretofore separable redemption coupons 22 have been used sparingly in publications or magazines 20, and that by far the more popular technique is to embody the coupon as part of the page itself, as already described in connection with the prior art showing of FIG. 1.

The improved method of achieving the result of FIG. 2A, but without the attendant expenses and difficulties in the preparation of the publication 20 as just alluded to, will now be described in connection with FIGS. 2B–2E. Shown in FIG. 2B is a printable paper substrate 30 on both surfaces of one end of which is imprinted with text and the like that is appropriate to enable the imprinted area to function as the previously noted redemption coupon 22. The imprinted material is represented by the arrangement of reference lines designated 32. To the end of facilitating ultimate removal of coupon 22, the previously noted perforations 24 are provided on the paper substrate 30 at the location illustrated. In accordance with the present invention, there is provided along the upper portion of coupon 22 a separation strip 34 which, in practice, would mostly be devoid of any printed material, although it is not necessary that this be so. The significance of separation strip 34 will become apparent as the description proceeds. As clearly illustrated in FIG. 2B, the remainder of the paper substrate 30 is imprinted with text, commercial messages, and other such material 36, as is appropriate to enable it to function as the previously noted associated advertising page 26 for the coupon 22. Preparation of the paper substrate 30 for the practice of the within method is completed by the deposit of drops of adhesive 38 at the strategic locations illustrated for a purpose soon to be explained.

The within method next contemplates further preparation of the paper substrate 30 as illustrated in FIG. 2C. More particularly, coupon 22 is bodily folded upon the advertising page 26, the fold occurring along a fold line located in the separation strip 34. For clarity of illustration, reference should be made to FIG. 2B in which the fold line in said separation strip 34 is designated 40. Following folding movement 42 of coupon 22, the coupon makes adhesive contact with the advertising page 26 as at the previously noted locations 38, and this prevents flapping in the coupon 22 which facilitates the handling of the paper substrate 30 in its folded condition as illustrated in FIG. 2C.

Using well known bindery equipment, paper substrate 30 in its FIG. 2C folded condition is then inserted in binding relation to the other pages 28 or, so-called signatures, of the publication 20. As understood, insertion movement 44 of insert 30 is achieved with handling equipment, specifically suckers and grabbers, which remove the insert 30 from a hopper and urge it along a movement path 44 so that the vertical edge 46 thereof is located in alignment with edges 48 of the signatures 28, so that these edges 46, 48 cooperate to form a spine of a so-called "perfect bound" magazine or publication 20.

Illustrated in FIG. 2E is the edge-trimming step in the production of the magazine or publication 20. Specifically, this step contemplates the application of guillotine type cutting implements which, as the result of cutting strokes, sheer the unbound edges of the publication as along the reference lines 50, 52 and 54. This is most significant since it should be readily appreciated that the trimming which occurs along line 54 of necessity occurs in the previously noted separation strip 34, and specifically inwardly of the fold line 40 located therein. This has the further significant effect of removing the only physical attachment between the coupon 22 and advertising page 26, thus rendering coupon 22 separable therefrom or, stated another way, capable of subsequent removal separate and apart from the advertising page 26. In this way, the publication 20 is provided with a separable, readily detachable redemption coupon 22 having the desirable product aspects as previously described and illustrated in FIG. 2A.

Another variation of a separable coupon for a magazine or publication is illustrated in FIG. 3E, and the process of achieving same illustrated in associated FIGS. 3A–3D. Since there are many structural features as well as steps in the method practiced to achieve these structural features similar to that which has already been described, these similar structural features will be designated with the same but primed reference numerals. Publication 20' of FIG. 3E has a separable, readily detachable redemption coupon 22' and not just one associated advertising page 26', but rather an additional second page, generally designated 56. As clearly illustrated in FIG. 3E, coupon 22' is sandwiched between the two associated advertising pages 56 and 26'.

As illustrated in FIG. 3A, paper substrate 30' is imprinted in an appropriate manner delineating, in the following order, the coupon 22' at one end, the separation strip 34', the advertising page 26' and, as new components, an additional separation strip 58 between page 26' and the previously noted additional page 56. Folding preparation of substrate 30' contemplates folding movement 42' of coupon 22' about fold line 40' which, of course, locates coupon 22' against the advertising page 26'. Next, the additional advertising page 56 is folded in the direction 60 along the fold line 62 on top of page 26'.

The folding preparation of substrate 30' is illustrated in FIG. 3B in which the position of the coupon 22' is one in which it is sandwiched between the pages 26' and 56 and it has a physical attachment to page 26', as along the separation strip 34'. The two pages 26' and 56 are also attached to each other, as along the separation strip 58.

The sectional view of FIG. 3C illustrates the adhesive attachment, as at 38', of the two pages to each other to facilitate handling during the production of the publication 20'.

The sectional view of FIG. 3D illustrates how the cutting stroke 64 of a guillotine cutter 66 or other such implement, as is usually employed in the edge-trimming step in the production of a magazine or publication 20', is effective in trimming the edge of page 56 to enhance the appearance thereof, and how this also is effective in removing the portion of the separation strip 34' inwardly of the fold line 40', to thereby remove the physical connection between the coupon 22' and page 26'.

Although not shown, the edge-trimming occurring along the top edge of the publication 20' will be understood to also remove that portion of the separation strip 58 which connects the two pages 56 and 26' to each other. Thus, following the usual edge-trimming in the production of the publication 20', the condition illustrated in FIG. 3E results, namely that there is provided associated advertising pages 56 and 26' on opposite sides of a separable, readily detachable redemption coupon 22'.

From the description already provided, it should be readily appreciated that quite a number of variations or combinations of separable redemption coupons and advertising pages can be provided using the inventive method hereof or a slight variation thereof. These combinations are in fact too numerous to specifically mention. On the other hand, for completeness sake, a further significant embodiment will now be described in connection with FIGS. 4A and 4B since it contemplates not one, but two separable redemption coupons. Again, to signify the relationship to descriptive matter already provided, use will be made of the same reference numerals, but having a double prime. Publication 20" of FIG. 4A is constituted with the one separable redemption coupon 22" on one side of the advertising page 26", and also with an additional separable redemption coupon 66 on its opposite side.

FIG. 4B illustrates the folding preparation of the paper substrate 31" to achieve the arrangement of an advertising page sandwiched between two redemption coupons. More particularly, printed coupon 22" is bodily folded against the lower portion of page 26" along a fold line in its cooperating separation strip 34". At the opposite end of the paper substrate 30", the additional redemption coupon 66 is folded down upon the opposite surface of the page 26" along a fold line located in the additional separation strip 58". As may be readily appreciated from prior discussion, the separation strips 34" and 58" are appropriately presented for trimming after the paper substrate 30" is inserted along with the other pages of the publication and this assemblage, after binding, is exposed to the edge-trimming step which, as understood, sheers the edges along a vertically oriented plane so as to provide a neat, trimmed appearance in the unbound edges of the publication. Said edge-trimming step thus removes the physical interconnection between the coupon 22" along the bottom of page 26" as well as the physical interconnection connection of the coupon 66 along the top of this page, thus resulting in the desirable arrangement of two separable redemption coupons along with an associated advertising page, all as is clearly illustrated in FIG. 4A.

From the foregoing it should be readily appreciated that there has been described herein a method in the preparation of a publication embodying the same with a separable, readily detached redemption coupon or the like which avoids the attendant expense and inconvenience in handling and feeding a smaller coupon-sized panel along with one or more associated advertising pages. In summary, one or more of the redemption coupons and associated advertising pages are printed as a unitary layout on a single paper substrate, and then properly prepared, by folding, so that the interconnection therebetween is presented for removal during the normal edge-trimming of the unbound edges of the publication, thereby representing a significant contribution to, and advance over, prior art technology for achieving the desired result of a separable redemption coupon or the like in a magazine or publication.

As used in the preceding description, as well as in the claims which follow, the broadest interpretation and meaning is to be accorded to the word "coupon", the same to include for example, a return envelope, a return post-card, and similar consumer type communication. It should be clear that the foregoing are within the contemplation of the present invention. In this connection, a latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A method in the preparation of a publication of binding a unitary printed redemption coupon and a pair of associated advertising pages in said publication preparatory to the subsequent removal of said coupon separate and apart from said advertising pages, said method comprising the steps of arranging on the same paper substrate a first advertising page, said redemption coupon adjacent one end thereof with a first separation strip delineating the coupon from said first advertising page, and the second advertising page adjacent the opposite end thereof with a second separation strip, parallel to the first separation strip, delineating the second advertising page from the first advertising page, positioning said redemption coupon bodily upon said first advertising page by folding the same along a fold line located in said first separation strip, positioning said second advertising page bodily upon said first advertising page by folding the same along a fold line located in said second separation strip, inserting said coupon and said advertising pages in said folded condition with said fold lines thereof in a horizontal orientation in binding relation with other pages of said publication, binding the aforesaid insert and pages together into a unitary publication, and trimming inwardly of the unbound three edges of said publication to contribute to a neat appearance therein, whereby the trimming of two of said publication edges is inwardly of said fold lines of said separtion strips to thereby separate said redemption coupon from said advertising pages so as to contribute to facilitated separate removal thereof.

2. A method of preparing a publication as claimed in claim 1 wherein at least said coupon is provided with perforations substantially parallel to the bound edge thereof.

3. A method in accordance with claim 1 wherein said second advertising page is folded over said redemption coupon to sandwich said redemption coupon between said advertising pages.

4. A method of providing a publication with at least one separable coupon including printing two panels located at the opposite end of a paper substrate with two spaced separation strips bounding an edge of each said panel, and successively bodily folding each of said panels upon said advertising page along horizontally oriented fold lines in each of said separation strips so that said fold lines are presented for trimming coincident with the upper and lower edges of said publication, whereby incident to said trimming said additional two panels are rendered separable from each other and from the remainder of said paper substrate.

5. A method of preparing a publication as claimed in claim 4 wherein said panel in the remote end position of said paper substrate is provided with perforations substantially parallel to the bound edge thereof, to thereby serve as another redemption coupon.

6. A method of preparing a publication as claimed in claim 4 wherein each said additional panel is page-size and imprinted with advertising, and wherein said redemption coupon is first folded upon said additional panel located in the medial portion of said paper substrate and said other additional panel then bodily folded over said coupon, whereby said edge trimming of said publication provides said separable redemption coupon with a strategic location between said two panels which are adapted to serve as advertising pages for said coupon.

7. A method in the preparation of a publication of binding a unitary advertising page and associated panels in said publication, said method comprising the steps of arranging on the same paper substrate the advertising page with the panels adjacent the upper and lower ends thereof with parallel separation strips delineating each panel from the advertising page, positioning the panels bodily upon the advertising page by folding the panels along parallel fold lines located in said separation strips, inserting said advertising page and panels in said folded condition with said fold lines thereof in a horizontal orientation in binding relation with other pages of said publication, binding the aforesaid insert and pages together into a unitary publication, and trimming inwardly of the unbound three edges of said publication to contribute a neat appearance thereto, whereby the trimming of the upper and lower edges of said publication is inwardly of said fold lines of said separation strips to thereby separate said panels from said advertising page.

8. The method of claim 7 wherein said panels are folded to overlie opposite faces of said advertising page.

9. The method of claim 7 wherein said panels are folded so as to overlie the same face of said advertising page.

10. The method of claim 7 wherein said advertising page and panels are arranged on said paper substrate in a manner whereby said advertising page and one panel are of substantially equal height are wherein the second of said panels is of a relatively lesser height.

* * * * *

UNITED STATES PATENT AND TRADEMARK OFFICE

CERTIFICATE OF CORRECTION

PATENT NO. : 4,126,333
DATED : November 21, 1978
INVENTOR(S) : Robert H. Dickinson It is certified that error appears in the above-identified patent and that said Letters Patent are hereby corrected as shown below:

Page 8, Claim 10, line 17 "are" should read -- and --.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*